US005159269A

United States Patent [19]

Moussavi

[11] Patent Number: 5,159,269

[45] Date of Patent: Oct. 27, 1992

[54] PROCESS FOR THE PREPARATION OF A RADICAL CATION SALT AND ITS USE IN AN ELECTRON PARAMAGNETIC RESONANCE (EPR) MAGNETOMETER

[75] Inventor: Mehdi Moussavi, Saint Egreve, France

[73] Assignee: Commissariat A L'Energie Atomique, Paris, France

[21] Appl. No.: 538,088

[22] Filed: Jun. 13, 1990

[30] Foreign Application Priority Data

Jun. 14, 1989 [FR] France ..... 89 07877

[51] Int. Cl.[5] ..... G01V 3/00; C25B 3/02

[52] U.S. Cl. ..... 324/301; 204/80

[58] Field of Search ..... 324/300, 301, 307, 309, 324/316; 204/80, 86, 72, 75

[56] References Cited

U.S. PATENT DOCUMENTS

| | | | |
|---|---|---|---|
| 3,648,157 | 3/1972 | Denis et al. | 324/301 |
| 3,702,831 | 11/1972 | Chiarelli et al. | 324/301 |
| 4,994,745 | 2/1991 | Mizuta | 324/316 |

OTHER PUBLICATIONS

Berichte Bunsengesellschaft Phys. Chem. vol. 91, 1987, pp. 950-957, V. Enkelmann: "Structure and phase transitions of aromatic radical cation salts".

*Primary Examiner*—Louis Arana

*Attorney, Agent, or Firm*—Oblon, Spivak, McClelland, Maier & Neustadt

[57] ABSTRACT

The invention relates to the preparation of a radical cation salt of formula:

$$(Ar)_2\cdot^+X^-$$

in which Ar is an optionally substituted aromatic hydrocarbon and $X^-$ an anion chosen from among $AsF_6-$, $SbF_6-$, $ClO_4-$, $Pf_6-$, $BF_4-$ and $((BC_6H_5)_4)$ by the electrochemical reaction of a solution of Ar in an organic solvent with a quaternary ammonium salt incorporating the anion $X^-$. The organic solvent is an alkyl formate, such as methyl or ethyl formate.

The radical cation salt can be used in an electron paramagnetic resonance (EPR) magnetometer, which comprises a tube (21) containing said salt (27) and a material able to absorb water and e.g. constituted by particles of a molecular sieve (23) mixed with alumina powder (25).

16 Claims, 4 Drawing Sheets

Figure 1:
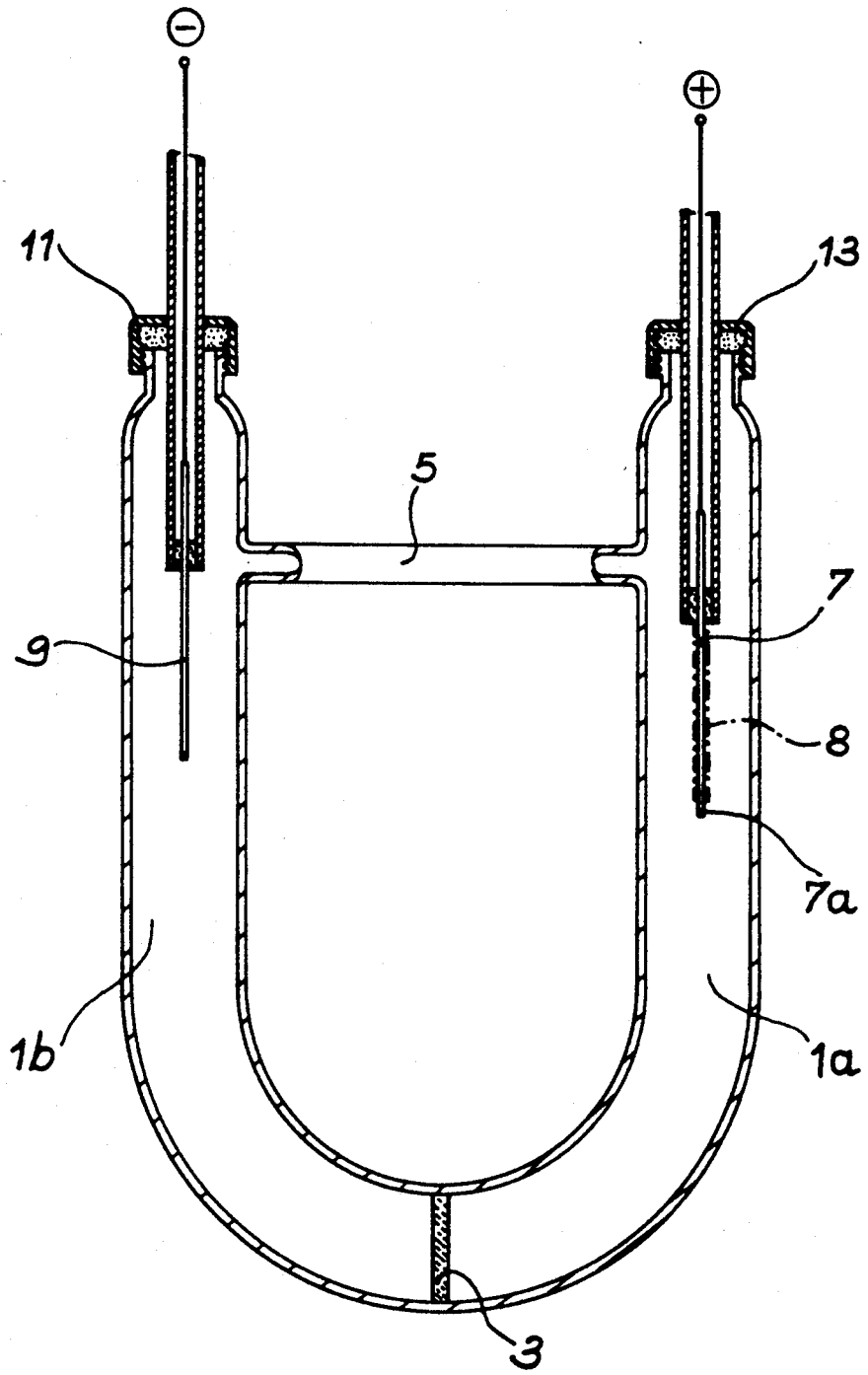

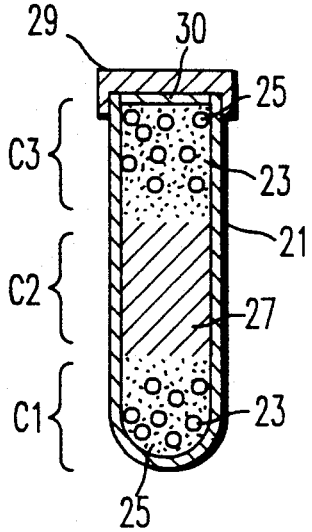
FIG. 2
FIG. 6
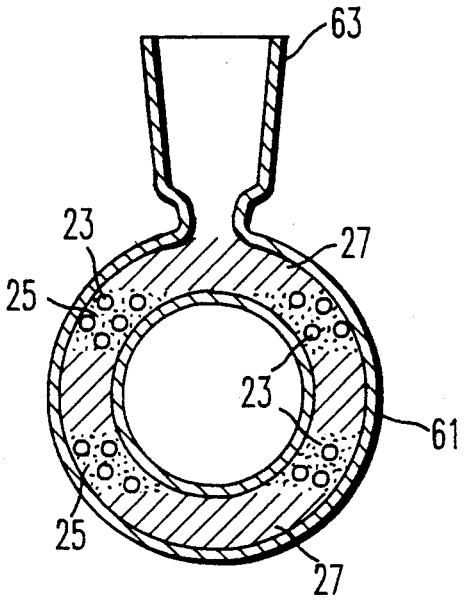
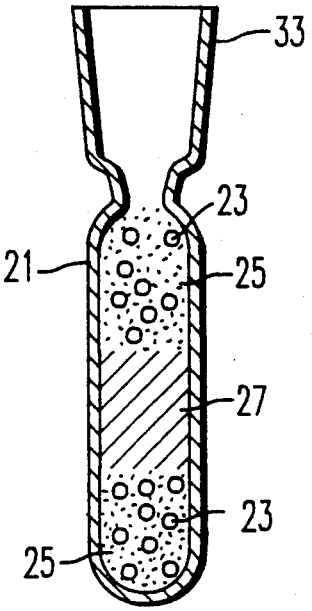
FIG. 3
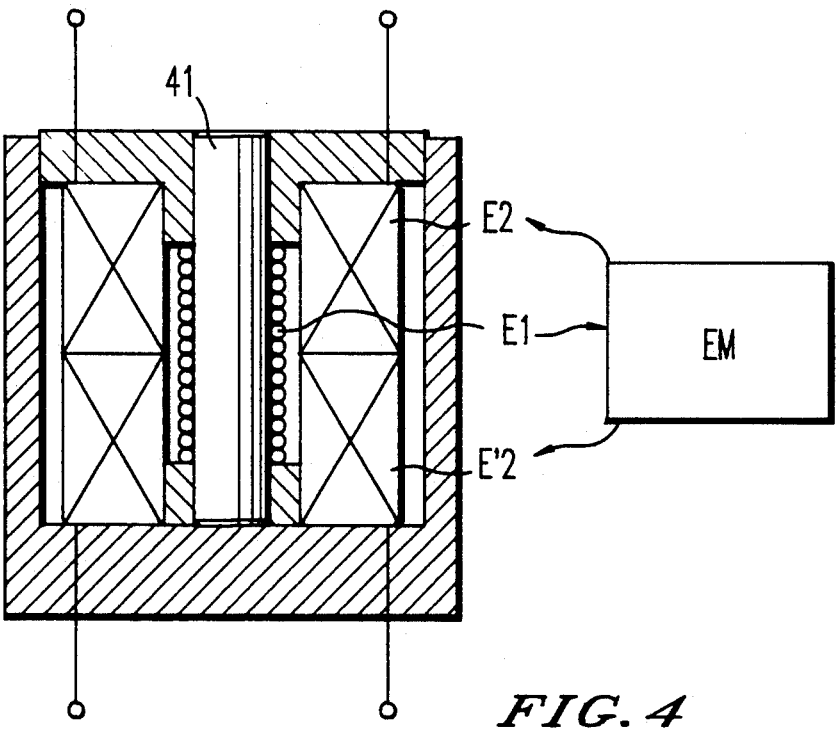
FIG. 4

PROCESS FOR THE PREPARATION OF A RADICAL CATION SALT AND ITS USE IN AN ELECTRON PARAMAGNETIC RESONANCE (EPR) MAGNETOMETER

The present invention relates to a process for the preparation of a radical cation salt usable in electron paramagnetic resonance (EPR) magnetometry.

More specifically, it relates to radical cation salts in accordance with the formula:

$$(Ar)_2\cdot^+X^-$$

in which Ar represents an optionally substituted aromatic hydrocarbon and X an anion such as $AsF_6$—, $ClO_4$—, $PF_6$—, $SbF_6$— and $B(C_6H_5)_4$—.

In such salts, Ar can represent more particularly naphthalene, fluoranthene, perylene, pyrene or triphenylene.

Radical cation salts of this type, e.g. fluoranthene hexafluorophosphate have recently been developed as a magnetometry material, because they have interesting EPR characteristics, as described by E. Dorman et al in Appl. Phys. A30, 227-231, 1983.

These radical cation salts can be prepared by electrochemical reaction between an aromatic hydrocarbon solution Ar in an appropriate organic solvent with a quaternary ammonium salt incorporating the $X^-$anion, as described by Krönke et al in Angew. Chem. Int., English Ed., 19, 1980, no. 11, 912-913.

However, although these radical cation salts have interesting characteristics, their development has been slowed down because they suffer from the disadvantage of not having an adequate stability, as in indicated in FR-A-2 603 384. Thus, fluoroanthene hexafluorophosphate crystals are stable at ambient temperature for a time of only two days to four weeks. Naphthalene hexafluorophosphate crystals have an even shorter stability of between two hours and two days at ambient temperature. However, when said crystals are stored in the refrigerator in sealed tubes, they have stability periods ranging between four and six months, but it is not possible to envisage this storage method, particularly for EPR magnetometry applications. Thus, it is difficult to use such salts in a EPR magnetometer probe which has to function for a long time in an autonomous manner and with few or not storage constraints.

The present invention relates to a process for the preparation of a radical cation salt of this type leading to a better stability, as well as to an EPR magnetometer probe containing such a salt and making it possible to obviate the disadvantages referred to hereinbefore.

The present invention therefore relates to a process for the preparation of a radical cation salt of formula:

$$(Ar)_2\cdot^+X^-$$

in which Ar is an aromatic hydrocarbon, which is either unsubstituted or substituted by at least one element chosen from the group constituted by halogen atoms and alkyl and alkoxy radicals and $X^-$ is an anion chosen from among $AsF_6$—, $SbF_6$—, $ClO_4$—, $PF_6$—, $BF_4$— and $B(C_6H_5)_4$—, by the electrochemical reaction of a solution of Ar in an organic solvent with a salt of formula $X^-NR^1R^2R^3R^4+$ in which $R^1$, $R^2$, $R^3$ and $R^4$, which are identical, represent an alkyl radical, characterized in that the organic solvent is an alkyl formate.

According to an advantageous feature of this process, the alkyl radical of the formate used as the solvent preferably has 1 to 2 carbon atoms.

Examples of such alkyl formates are methyl formate and ethyl formate.

Preferably, according to the invention, the alkyl formate is purified in order to eliminate the traces of acid, water and alcohol contained therein, prior to its use for performing the process according to the invention.

This purification can be carried out by stirring the solvent on $Na_2CO_3$ or $K_2CO_3$ and by distillation in the presence of $P_2O_5$. In the case of ethyl formate, it is also possible to contact it with $CaH_2$ and then distil it in the present of $CaH_2$.

The use of such organic solvents makes it possible to improve the stability of the radical cation salts.

Thus, it has been found that the stability deficiency of radical cation salts of the $(Ar)_2\cdot^+X^-$ type is due to the presence of traces of water, because these salts react with water during decomposition, e.g. in accordance with the following reaction diagram in the case of fluoroanthene hexafluorophosphate:

$$2(FA)_2PF_6+9H_2O—2H_3PO_4+12HF+1/2O_2+4\text{-}(FA)$$

In the reaction diagram FA stands for fluoroanthene.

This reaction takes place even if the water is only present in trace form, particularly in inclusions in the crystals produced during the electrorystallization of fluoroanthene hexafluorophosphate by conventional processes.

The prejudicial effects of this decomposition reaction are the production of phosphoric and hydrofluoric acids, which speed up the degradation of the radical by the catalytic effect and the widening of the PER line of the salt due to the evolution of oxygen, because a coupling occurs between the electron spin of the radical and the paramagnetic oxygen.

These effects lead to the formation of microcrystals of aromatic hydrocarbon Ar, e.g. fluoroanthene, which is generally white and is deposited on the surface of the crystals of the radical cation salt (black) or violet) giving them a grey colour. Moreover, the evolution of hydrofluoric acid (white fumes) makes the walls of the EPR magnetometry probe opaque, because they are generally made from glass, which is attacked by hydrofluoric acid.

In the process according to the invention, the electrocrystallization of the radical cation salt takes place in the absence of water due to the choice of solvent used, which makes it possible to obtain a substantially water-free salt, whilst improving its stability. However, in order to be able to use this salt for a prolonged period in an EPR magnetometer, it is necessary to modify the probes containing said salt and which are used in EPR magnetometry, in order to further increase the stability of the radical cation salt.

The invention also relates to a probe for an EPR magnetometer, which comprises a tube containing a substance having a water-sensitive electron magnetic moment, such as radical cation salt, as well as a material able to absorb water and not giving a parasitic EPR signal.

The radical cation salt is in particular the aforementioned salt of formula $(Ar)_2\cdot^+X^-$ and preference is given to the use in the inventive probe of a salt of this type obtained by the inventive process.

The material able to absorb water used in the probe can in particular be a zeolitic molecular sieve. The latter are absorbent crystalline substances, which have pore which can be filled with molecules of corresponding dimensions. In the probe according to the invention, use is made of this property of molecular sieves to trap the traces of water, solvent or hydrofluoric acid which could emanate from the radical cation salt. This prevents the aforementioned decomposition reaction from occurring and leads to an increase in the stability of the radical cation salt.

According to a preferred embodiment of the probe according to the invention, the tube contains at least one layer of a substance having an electron magnetic moment, each substance layer having an electron magnetic moment being placed between two layers of material able to absorb water.

In this case, in order to obtain a good EPR signal, it is preferable for each substance layer having an electron magnetic moment to be in direct contact with the wall of the tube and with the two layers of material able to absorb water surrounding the same.

According to a variant of this embodiment, the layers of material able to absorb water also incorporate a basic alumina powder.

Thus, when the material able to absorb water is constituted by molecular sieve particles, it may be advantageous to mix them with the alumina powder, because this leads to an increase in the compactness of the unit formed by the molecular sieve and dispersion of the substance having an electron magnetic moment, e.g. a radical cation salt through the molecular sieve layer is prevented.

Moreover, due to the fact that alumina is basic, it can fix the possibly formed hydrofluoric and phosphoric acid traces.

Generally the molecular sieve used in an aluminosilicate or a mixture of aluminosilicates having pores of approximately 0.4 to 1 nm.

Good results are obtained when using a molecular sieve of type 4A, which is a sodium aluminosilicate with a pore size of 0.4 nm, a molecular sieve of type 5A, which is a calcium aluminosilicate with a pore size of 0.5 nm and a molecular sieve of type 13X, which is a crystalline sodium aluminosilicate having a pore size of approximately 1 nm.

The alumina powder used can e.g. be basic $Al_2O_3$ of activity I (without water).

The probe according to the invention containing a substance having an electron magnetic moment, e.g. constituted by a radical cation salt can be used in an EPR magnetometer, which in conventional manner comprises a probe constituted by a tube containing a substance having an electron magnetic moment, a first winding $E_1$ wound around said tube and able to produce a voltage due to the magnetic flux variation resulting from the precession of the electron magnetic moment around an ambient magnetic field (HO), said voltage having a so-called Larmor frequency of $\gamma HO/2\pi$, in which $\gamma$ is the gyromagnetic ratio of the substance used, a second winding $E_2$ able to produce a rotary magnetic field $H_1$ at said Larmor frequency in order to maintain the precession, and electronic means able to measure the frequency of the signal taken at the terminals of the first winding, which gives the modulus of the ambient magnetic field HO and supply the maintenance field $H_1$.

The invention is described in greater detail hereinafter relative to non-limitative embodiments and the attached drawings, wherein show:

FIG. 1 Diagrammatically and in vertical section an electrocrystallization apparatus for preparing the radical cation salt according to the process of the invention.

FIG. 2 A cylindrical probe for an EPR magnetometer according to the invention.

FIG. 3 An embodiment of a cylindrical probe according to the invention.

FIG. 4 Diagrammatically an EPR magnetometer incorporating a cylindrical probe.

Figure 5:
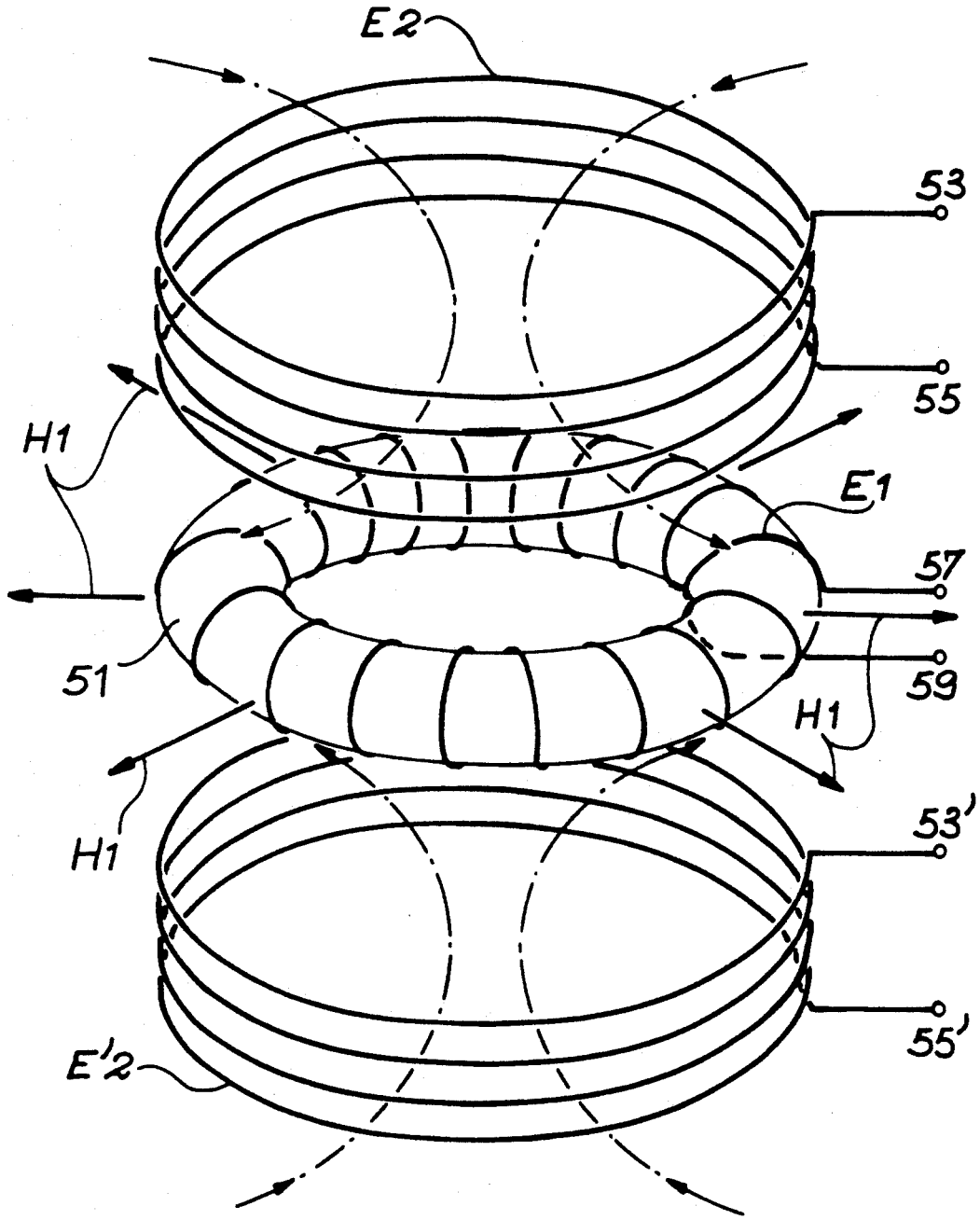

FIG. 5 Diagrammatically an EPR magnetometer incorporating a toroidal probe.

FIG. 6 The construction of a toroidal probe according to the invention.

Figure 7:
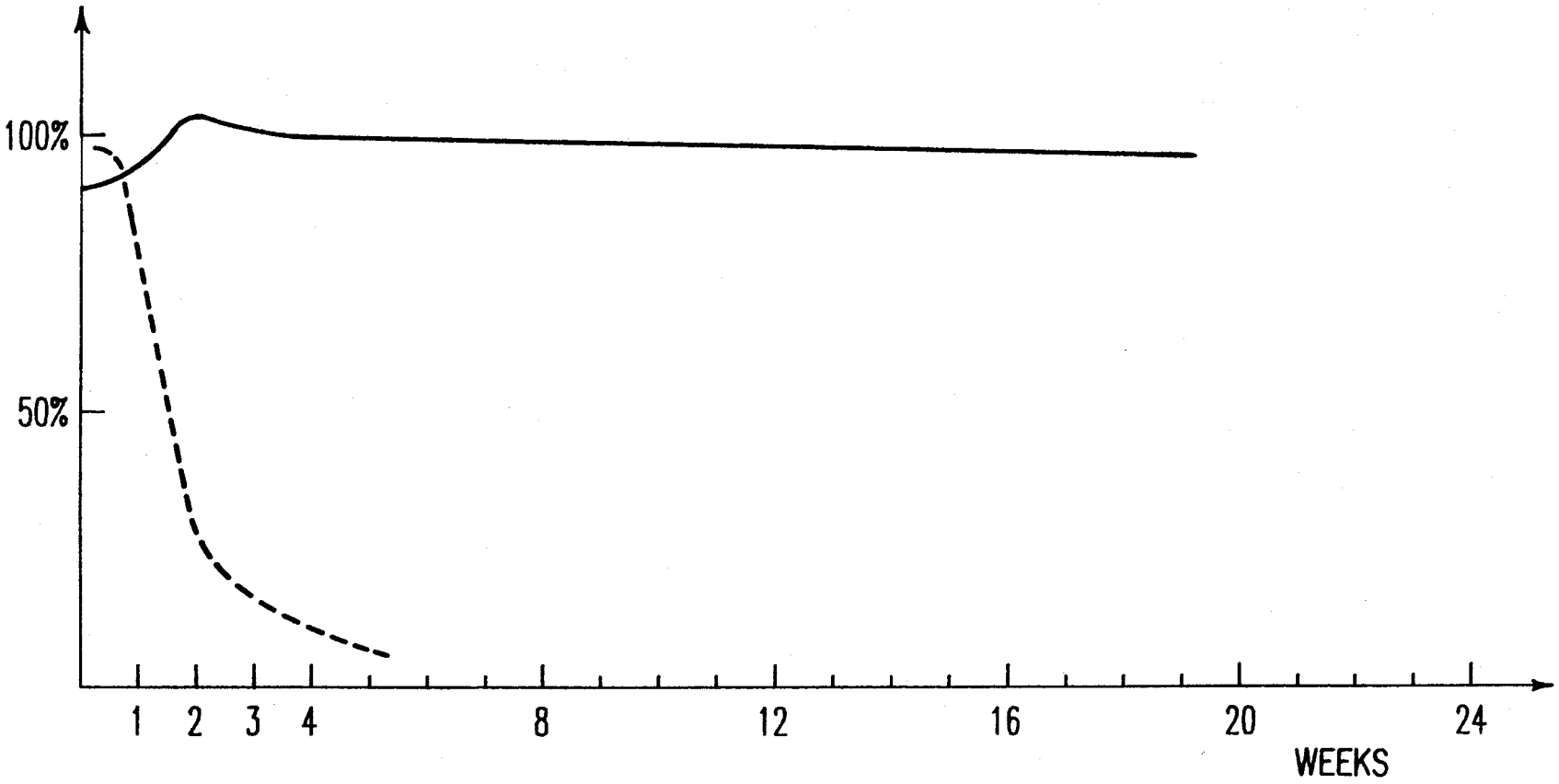

FIG. 7 A graph showing the evolution of the EPR characteristics of the material according to the invention as a function of time (curve 1), whilst also giving the evolution of the characteristics of a prior art material as a function of time (curve 2).

FIG. 1 shows an electrocrystallization cell making it possible to perform the process of the invention. This cell is constituted by a U-shaped tube 1 subdivided into two compartments 1*a* and 1*b* by a fritted glass diaphragm 3. In the upper part of the U-shaped tube a duct 5 makes it possible to connect the upper ends of the two compartments 1*a* and 1*b* in order to balance the pressures in the two compartments.

Compartment 1*a* comprises a platinum electrode 7 connected to the positive pole of a current generator, which is partly covered with a polytetrafluoroethylene sheath 8, except at its lower end 7*a*, in order to leave free an electrode length of 1 to 2 mm.

Compartment 1*b* is provided with an electrode 9 also made from platinum and which is connected to the negative pole of a current generator. The two compartments are hermetically sealed by the plugs 11 and 13.

A description will not be given of the use of this electrocrystallization cell for the preparation of fluoroanthene hexafluorophosphate using methyl formate as the solvent.

Firstly the methyl formate is purified in order to eliminate the traces of water, acid and alcohol contained therein, by washing it with a concentrated aqueous $Na_2CO_3$ solution, then drying it on solid $Na_2CO_3$ and distilling it in the presence of $P_2O_5$.

This is followed by the preparation of a solution of fluoroanthene and tetrabutyl ammonium hexafluorophosphate by dissolving 0.9 g of fluoroanthene and 1.2 g of tetrabutyl ammonium hexafluorophosphate in 150 ml of the thus purified methyl formate. This solution is introduced into the electrocrystallization cell 1 and a constant current of 30 $\mu$A is applied to the terminals of the platinum electrodes 7 and 9, which are immersed in the solution and whilst maintaining a temperature of $-30°$ C. This leads to the formation of fluoroanthene hexafluorophosphate crystals in the form of 0.5 to 1.5 cm black needles with violet reflections. After electrocrystallizing for 7 days, these crystals are isolated by filtration and washed 3 times with 50 ml of purified methyl formate. These crystals are then transferred into a glove box equipped with a purification means and a device for measuring the oxygen level and the moisture level.

Into the glove box is also introduced a selection of 0.4, 0.5 and 1 nm molecular sieves, as well as appropriately shaped calibrated tubes for EPR magnetometer probes, Apiezon L grease and basic alumina of Activity 1 from Prolabo.

The tubes can be of glass or some other material, e.g. a plastics material, are gastight and give no parasitic EPR signal. They can have different shapes as a function of the magnetometer used and can e.g. be cylindrical or toroidal.

This is followed by the production of EPR magnetometer probes in said glove box in order to maintain the degree of purity of the radical cation salt and obtain the desired stability.

FIG. 2 shows a cylindrical probe for an EPR magnetometer according to the invention. It can be seen that the probe comprises a cylindrical glass tube 21 having the requisite quality for EPR and within which are successively arranged a first layer C1 of water-absorbing material 23, which is in this example associated with alumina powder 25, a second layer C2 of a substance having an electron magnetic moment 27, such as a radical cation salt, and a third layer C3 of water-absorbing material 23 associated with alumina powder 25. The upper part of the tube is sealed by a plug 29, a hydrophobic grease layer 30 being interposed between the plug 29 and the layer C3.

This probe is produced by successively introducing into the tube 21 the mixture of particles of the 0.4, 0.5 and 1 nm molecular sieves 23 and the alumina powder 25 in order to form the first layer C1 and then the radical cation salt obtained hereinbefore, namely fluoroanthene hexafluorophosphate 27 and then once again the molecular sieve mixture 23 associated with the alumina powder 25. The tube is then sealed by the plug 29 after adding the Apiezon L hydrophobic grease layer 30.

In the embodiment shown in FIG. 2, the tube diameter is 10 mm and each of the three layers C1, C2 and C3 have a height of 15 mm.

As a variant, it is possible to vacuum seal the tube in the manner shown in FIG. 3. In this case the tube 21 is surmounted by a ground glass opening 33, which can be connected to a row of vacuum cocks and it is then vacuum sealed. In this case, the hydrophobic grease layer 30 can be eliminated.

In the probe of FIGS. 2 and 3, the alumina powder 25 makes it possible to increase the compactness of the layers C1 and C3 of molecular sieves 23, thus avoiding the dispersion of the radical cation salt 27 between the molecular sieve particles 23 of the layers C1 and C3. In addition, as the alumina is basic, it makes it possible to fix the possibly formed phosphoric and hydrofluoric acid traces.

The arrangement of layers as shown in FIG. 2 is important, because it makes it possible to obtain a good EPR signal, by giving the best filling coefficient of the tube with radical cation salt without interposing any other material between the tube wall and the salt, whilst still having the largest possible contact surface between the molecular sieves and the radical cation salt. Thus, a much lower sensitivity would be obtained on placing molecular sieve layers of radical material in the radial direction instead of the longitudinal direction, because the detection coils generally placed around the tube would not make it possible to extract the maximum EPR signal from the radical cation salt. The same would be the case on including separating membranes or diaphragms between the layers C1, C2 and C3 in the arrangement of FIG. 2.

The probe described in FIGS. 2 and 3 can be used in a cylindrical probe EPR magnetometer as shown in FIG. 4. It can be seen that the magnetometer comprises a probe 41 constituted by a cylindrical tube containing a substance having an electron magnetic moment, e.g. the probe shown in FIG. 2. The probe is surrounded by a first winding $E_1$ wound around the tube and able to produce a voltage due to the magnetic flux variation resulting from the precession of the electron magnetic moment about an ambient magnetic field HO. It is associated with two windings $E_2$ and $E'_2$ constituted by Helmholtz coils making it possible to create a rotary magnetic field $H_1$ at the Larmor frequency in order to maintain the precession. The magnetometer also comprises electronic means EM on the one hand for measuring the frequency of the signal taken at the terminals of the winding $E_1$ and on the other hand for supplying the rotary magnetic field $H_1$.

The probe according to the invention can also be toroidal, as described in French patent FR-A-2 603 384.

FIG. 5 diagrammatically shows an EPR magnetometer having such a probe 51. In this case, the winding E1 is wound around the torus 51 and two coils $E_2$ and $E'_2$ are associated with the probe 51 on either side of the median plane of the latter. They are coaxial to the probe 51, but are supplied in such a way that the magnetic fields which they produce are in opposition. This leads to field lines forming a radial distribution field H1 in the median plane of the probe 51.

The connections 53, 55 and 53', 55' make it possible to supply current to the coils E2 and E'2, whilst the connections 57, 59 make it possible to tap the signal from the winding E1.

The toroidal probe 51 can be produced in the manner shown in FIG. 9 by successively filling a toroidal glass tube 61 with alternate layers of radical cation salt 27 and the mixture of molecular sieves 23 and alumina 25. It is possible to more particularly use a toroidal tube 61 surmounted by a ground glass opening 63 which is used for filling purposes and then connect the opening to a row of vacuum cocks and finally vacuum seal the torus. As hereinbefore, in this case it is not necessary to place a grease layer at the tube seal.

As in the case of the cylindrical tube of FIG. 2, the arrangement of the radical cation salt and the molecular screens must not be symmetrical in order to maintain the isotropy of the probe and to obtain the best possible compromise between the life of the probe and the sensitivity of the magnetometer.

The probe obtained according to the invention was used in the structure shown in FIG. 2 for measuring a significant characteristic of the PER signal of the probe and said measurement was carried out as a function of time over a period of 24 weeks using the EPR spectrometer described in Synthetic Metals, 27, 1988, B175-B180.

The results obtained are given in FIG. 7, where curve I represents the evolution (as a %) of said EPR characteristic as a function of the time (in weeks). This characteristic is maintained for 24 weeks. Curve II also represents the evolution of the same characteristic as a function of time for an EPR probe produced according to the prior art.

In both cases use was made of a pyrex glass tube with a diameter of 5 mm and sealed under a secondary vacuum of $10^{-5}$ mbars and 100 g of fluoroanthene hexafluorophosphate obtained according to the process of the invention, but the probe according to the invention had the structure shown in FIG. 2. The two probes were kept at ambient temperature of 20° to 25° c.

Under these conditions and as shown by curve II of FIG. 7, the EPR characteristic of the prior art probe is not maintained because, at the end of 4 weeks, it is substantially zero.

I claim:

1. An electron paramagnetic resonance (EPR) magnetometer comprising a probe constituted by a tube, wherein said tube contains a substance having an electron magnetic moment, said substance being able to react with water, and a material able to absorb water and not giving a parasitic EPR signal, a first winding ($E_1$) wound around said tube, said first winding being able to produce a voltage due to a magnetic flux variation resulting from precession of the electron magnetic moment around an ambient magnetic field (HO), said voltage having a so-called Larmor frequency equal to $\gamma HO/2\mu$, in which $\gamma$ is the gyromagnetic ratio of the substance used, a second winding ($E_2$) able to produce a rotary magnetic field ($H_1$) at said Larmor frequency in order to maintain the precession, and electronic means able on the one hand to measure the frequency of the signal taken at the terminals of the first winding, which gives the modulus of the ambient magnetic field (HO) and on the other hand supply the maintenance field ($H_1$).

2. Process for the preparation of a radical cation salt of formula:

$$(Ar)_2\cdot^+X^-$$

in which Ar is an aromatic hydrocarbon, and $X^-$ is an anion chosen from among $AsF_6$—, $SbF_6$, $ClO_4$—, $PF_6$, $BF_4$— and $B(C_6H_5)_4$—, by the electrochemical reaction of a solution of Ar in an organic solvent with a salt of the formula $X^-NR^1R^2R^3R^4+$ in which $R^1$, $R^2$, $R^3$ and $R^4$, which are identical, represent an alkyl radical, characterized in that the organic solvent is an alkyl formate.

3. Process according to claim 2, characterized in that the alkyl formate is methyl formate.

4. Process according to claim 2, characterized in that the alkyl formate is ethyl formate.

5. Process according to claim 1, characterized in that the alkyl formate is purified in order to eliminate the traces of acid, water and alcohol contained therein prior to use in the process.

6. A process for the preparation of a radical cation salt according to claim 2, wherein Ar may be unsubstituted, or substituted by at least one element chosen from the group consisting of halogen atoms, alkyl radicals and alkoxy radicals.

7. Process according to claim 6, characterized in that Ar represents an aromatic hydrocarbon chosen from among naphthalene, fluoroanthene, perylene, pyrene and triphenylene.

8. Process according to claim 6, characterized in that Ar represents fluoroanthene and $X^-$ represents $PF_6$—.

9. A probe for an electron paramagnetic resonance (EPR) magnetometer, comprising a tube, wherein said tube contains a substance having an electron magnetic moment, said substance being able to react with water, and a material above to absorb water and not giving a parasitic EPR signal.

10. Probe according to claim 9, characterized in that the substance having an electron magnetic moment is a radical cation salt in accordance with the formula:

$$(Ar)_2\cdot^+X^-$$

in which Ar is an aromatic hydrocarbon, which may be unsubstituted, or substituted by at least one element chosen from the group constituted by halogen atoms and alkyl and alkoxy radicals and $X^-$ is an anion chosen from among $AsF_6$—, $SbF_6$—, $ClO_4$—, $PF_6$—, $BF_4$— and $B(C_6H_5)_4$—, by the electrochemical reaction of a solution of Ar in an organic solvent with a salt of formula $X^-NR^1R^2R^3R^4+$ in which $R^1$, $R^2$, $R^3$, $R^4$, which are identical, represent an alkyl radical.

11. Probe according to claim 10, wherein said organic solvent is an alkyl formate.

12. Probe according to claim 9, characterized in that the material able to absorb water is a zeolitic molecular sieve.

13. Probe according to claim 9, characterized in that the material able to absorb water is an aluminosilicate or a mixture of aluminosilicates having pores of approximately 0.4 to 1 nm.

14. Probe according to claim 9, characterized in that the tube contains at least one layer of a substance having an electron magnetic moment, each substance layer having an electron magnetic moment being placed between two layers of material able to absorb water.

15. Probe according to claim 14, characterized in that the layers of material able to absorb water also incorporate a basic alumina powder.

16. Probe according to one of the claims 14 or 15, characterized in that each substance layer having an electron magnetic moment is in direct contact with the wall of the tube and with the two layers of material able to absorb water surrounding it.

* * * * *